United States Patent [19]

Toupin et al.

[11] Patent Number: 5,050,408

[45] Date of Patent: Sep. 24, 1991

[54] DIAPER CLEANING DEVICE

[76] Inventors: John Toupin, 32910 W. 13 Mile, Farmington Hills, Mich. 49024; Joel Toupin, 207 Wabasso, Walled Lake, Mich. 48088

[21] Appl. No.: 585,237

[22] Filed: Sep. 20, 1990

[51] Int. Cl.[5] ..... D06F 51/00

[52] U.S. Cl. ..... 68/241; 4/666

[58] Field of Search ..... 68/213, 214, 235 D, 68/241; 4/666; 15/260; 220/522

[56] References Cited

U.S. PATENT DOCUMENTS

| | | | |
|---|---|---|---|
| 944,071 | 12/1909 | Brewer | 68/235 D X |
| 1,523,751 | 1/1925 | Carette | 15/260 |
| 2,780,402 | 2/1957 | Zucker et al. . | |
| 3,142,063 | 7/1964 | Leventhal . | |
| 3,253,435 | 5/1966 | Berk et al. | 68/235 D X |
| 3,338,076 | 8/1967 | Williams et al. | 68/241 |
| 3,364,512 | 1/1968 | Yamashita et al. | 15/260 |
| 3,610,003 | 10/1971 | Perrin et al. | 68/235 D X |
| 3,611,758 | 10/1971 | Miller et al. . | |
| 4,516,975 | 5/1985 | Mitchell . | |
| 4,642,832 | 2/1987 | Trisolini | 15/260 X |
| 4,681,581 | 7/1987 | Coates . | |
| 4,692,163 | 9/1987 | Widlund et al. . | |
| 4,781,277 | 11/1988 | Lim . | |

*Primary Examiner*—Philip R. Coe

*Attorney, Agent, or Firm*—Gifford, Groh, Sprinkle, Patmore and Anderson

[57] ABSTRACT

An apparatus for substantially removing waste from a soiled diaper is disclosed. The apparatus comprises a waste removing portion having a conical body. The body includes a first end aperture and a second end aperture, said first end aperture being wider than said second end aperture. The conical body includes a slot preferably defined on the bottom side thereof from said first end to said second end through which an edge of the diaper is drawn and through which waste passes once drawn out of said diaper. The body may include a handle. A container is optionally provided as a place to temporarily hold the waste. Tongs are also optionally provided to facilitate grabbing and drawing the soiled diapers through the conical body.

15 Claims, 2 Drawing Sheets

DIAPER CLEANING DEVICE

BACKGROUND OF THE INVENTION

I. Field of the Invention

The present invention relates generally to devices for cleaning diapers. More particularly, the present invention relates to such a device comprising a conical body through which a soiled diaper is passed for preliminarily removing the waste therefrom.

II. Description of the Relevant Art

For new babies and for very young babies, diapers and the like are appropriately worn until such time as the young child is potty trained. The use of diapers or similar articles is actually very ancient, and only within the last twenty years or so has there been movement away from the utilization of diapers in their traditional cloth form to the so-called "disposable" diaper. This movement, while bringing considerable convenience to the child's parents, has also created at least one new problem, that being the problem of disposal. Accordingly, many parents of babies are now reconsidering the selection made by their predecessors of disposable diapers.

In addition to eliminating the threat posed to the environment by disposable diapers, cloth diapers also have other advantages, including hygienic advantages directed specifically at reducing the frequency of diaper rash.

However, even for its noted advantages, cloth diapers were readily abandoned by many in favor of disposable diapers because of their sheer convenience. The main problem with cloth diapers is that, once soiled, they are inconvenient to clean.

The parents of a baby or young child have two choices for the cleaning of cloth diapers. First, and most commonly, diapers are cleaned at home. The other choice is to engage a diaper cleaning service that picks up soiled diapers and returns clean diapers.

However, in either case, it is necessary for the user to preliminarily remove waste from the diaper. This means that the parent cannot simply remove the soiled diaper from the child and place the diaper in a washing machine directly or in a bin for a diaper service to retrieve. Specifically, the parents of a baby must remove solid, semi-solid and liquid waste from the diaper, this procedure most often being undertaken by preliminarily rinsing out the diaper in the toilet. Thereafter, the diaper is placed into an initial cleaning basin and then is removed to a finish cleaning basin or machine for washing.

However, after the preliminary cleaning of the diaper in the toilet, the diaper should be wrung in an effort to remove as much solid, semi-solid and liquid waste from the diaper as possible. Cleaning solvent, here water, should also be removed at this time.

In an effort to meet this need, wringing systems including some having at least one roller have been devised. While these systems endeavor to solve one problem however, they prove, in many ways, to be extremely impractical because of the complexity of the mechanisms directed at wringing.

Accordingly, known approaches to wringing out preliminarily washed diapers have failed to solve the problems commonly associated therewith.

SUMMARY OF THE PRESENT INVENTION

The present invention provides an apparatus for substantially removing solid, semi-solid, and liquid waste from a soiled diaper. The apparatus comprises a waste removing portion that includes an elongated conical body having a first end aperture for receiving the soiled diaper and a second end aperture from which the diaper is ultimately drawn. The first end aperture is wider than the second end aperture, thereby accomplishing a squeezing effect upon the soiled diaper as it is drawn through the body of the apparatus. Along the lower side of the apparatus of the body is defined a slot from the first end aperture to the second end aperture. A corner portion of the soiled diaper is grasped by the user and drawn through the slot from the first end aperture toward and through the second end aperture. The bulk of the body of the diaper is drawn through the body with only the grasped corner portion remaining outside of the body. As the soiled diaper is drawn through and thereby squeezed by the body, waste material is exhausted from the body through the slot.

For the convenience of the user, a handle is provided on the top side of the body. Preferably, the handle is disposed longitudinally in relation to the longitudinal axis of the elongated body.

As a preferred option, a pair of tongs are provided to grip and then subsequently pull the soiled diaper through the conical body after the diaper has been disposed therein. To facilitate easy disposition of the diaper into the conical body, the first end of the conical body is preferably bell-shaped.

To use the apparatus, the preliminarily rinsed diaper is inserted into the first end aperture of the conical body and is subsequently gripped and drawn through the body by the user from the second end aperture.

As a further preferred option of the present invention, a waste container is provided whereby the body portion may be temporarily inserted and also where waste removed from the soiled diaper may be temporarily disposed. Preferably, this container may be fitted with a receiving and holding area for the tongs.

For fitting the body portion snugly to the container, the body portion is preferably fitted with a substantially planar lid portion interfitted between the body and the handle disposed in the top thereof. The disk diameter is substantially equivalent to the opening on the top side of the container, thereby providing a snug fit when the body portion is fitted thereto. As required, any waste trapped inside the container may be easily removed by the user pouring the waste from the container into the toilet.

The preferred material for the composition of the apparatus of the present invention is a sturdy polymerized material, such as a PVC-type plastic or other durable, yet inexpensively produced polymerized material.

Other advantages and features of the present invention will become more apparent from the following detailed description when read in conjunction with the accompanying drawings.

BRIEF DESCRIPTION OF THE DRAWING

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENTS OF THE PRESENT INVENTION

Figure 1:
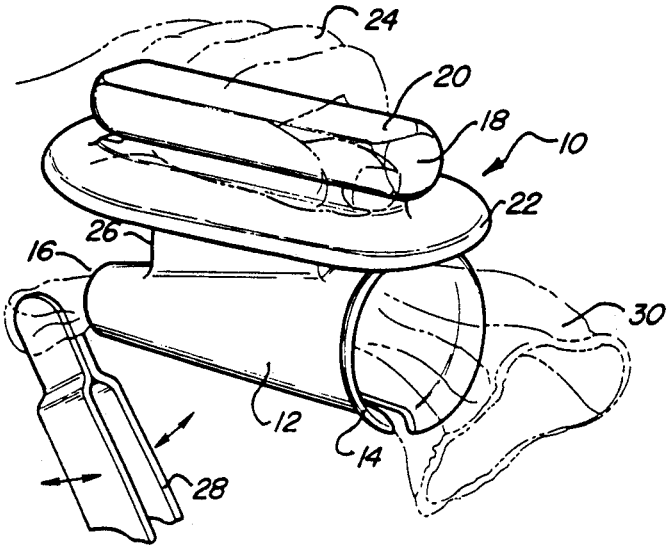
FIG. 1 is a perspective view illustrating the present invention being held by a user and showing the soiled diaper being drawn therethrough.

The drawing discloses the preferred embodiments of the present invention. The configurations according to the illustrated embodiments are preferred, it is envisioned that alternate configurations of the present invention may be adopted without deviating from the invention as portrayed. The preferred embodiments are discussed hereafter.

Referring to FIG. 1, a waste removing portion of an apparatus for removing waste from a soiled diaper is illustrated generally as 10. The waste removing portion 10 comprises an elongated conical body 12 having a first end aperture 14 and a second end aperture 16.

Situated above the body 12 is a holding portion 18. The holding portion 18 comprises a handle 20 and a lid portion 22. The handle 20 is preferably elongated as illustrated to provide the user with a means of firmly grasping the waste removing portion 10 in a practical way.

It is envisioned that an alternate handle (not shown) such as an upright shaft or a knob may be substituted for the elongated handle 20.

The lid 22 serves a dual purpose. First, the lid 22 protects the user's hand, illustrated here as 24, from being splashed or dirtied while using the waste removing portion 10. Second, the lid 22 acts as a cover when the waste removing portion 10 is used in combination with a holding canister, illustrated in FIG. 5 and discussed more fully in relation thereto.

Interconnecting the underside of the lid 22 and the body 12 is a bridge 26.

To use the present invention, a corner of the soiled diaper 30 is grasped by the user with a pair of tongs 28. The corner is drawn through a slot 32 (see FIG. 3) from the first end aperture 14 to the second end aperture 16 so that the bulk of the body of the diaper 30 is drawn through the conical body 12. The drawing process forces the waste material to be squeezed from the diaper 30 as it is pulled through an area of constantly decreasing diameter.

Figure 2:
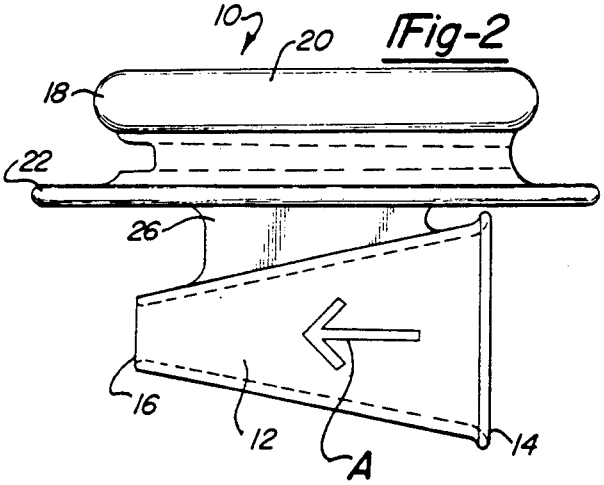
FIG. 2 is a side view illustrating the preferred construction of the conical body (shown in section) and associated handle of the present invention.

FIG. 2 illustrates a cross section of the waste removing portion 10 according to the present invention as viewed from the side according to the longitudinal axis of the body. The arrow "A" illustrates the general direction of travel of the soiled diaper 30 (not illustrated).

To smoothly accommodate the insertion of the diaper 30 into the first end aperture 14 of the body 12, the first end aperture 14 preferably defines a slight bell-shape, as illustrated.

Figure 3:
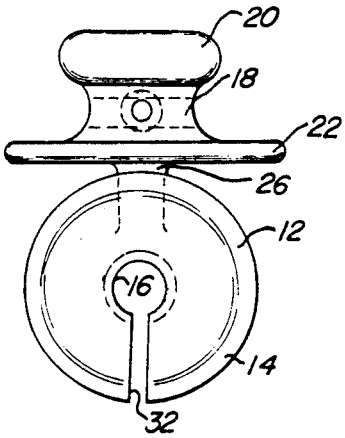
FIG. 3 is a front view of the view of FIG. 2 looking toward the first end aperture of the conical body.

FIG. 3 discloses an elevational view of the waste removing portion 10 when viewed from the first end aperture 14. This view emphasizes the conical shape of the body 12.

Interconnecting the first end aperture 14 and the second end aperture 16 is the slot 32. In addition to allowing the user to draw the diaper 30 therethrough, the slot 32 provides an exhaust outlet through which the removed waste may be dispensed as the diaper 30 is drawn through the body 12.

Figure 4:
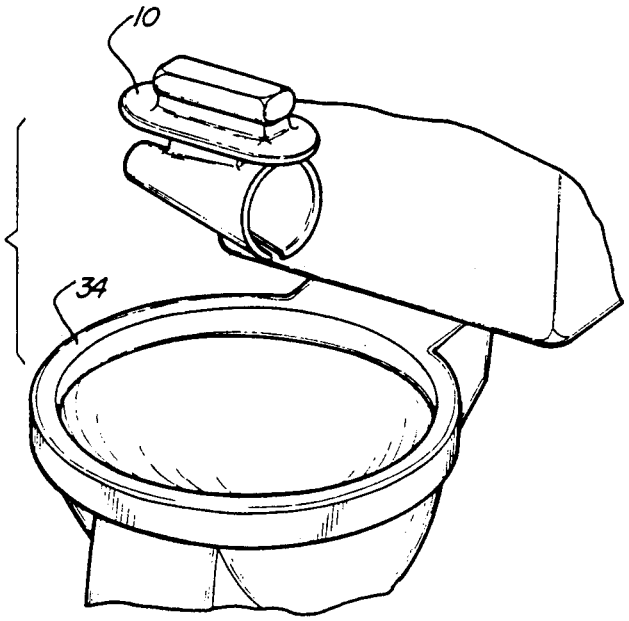
FIG. 4 is a perspective view illustrating the conical body portion disposed above and relative to a toilet according to its preferred use.

Referring to FIG. 4, the waste removing portion 10 is shown suspended above a toilet 34. This positioning provides a user with a practical and convenient method of cleanly using the waste removing portion 10. After one or more soiled diapers are drawn through the portion 10, the toilet 34 is simply flushed to eliminate the resulting waste.

Figure 5:
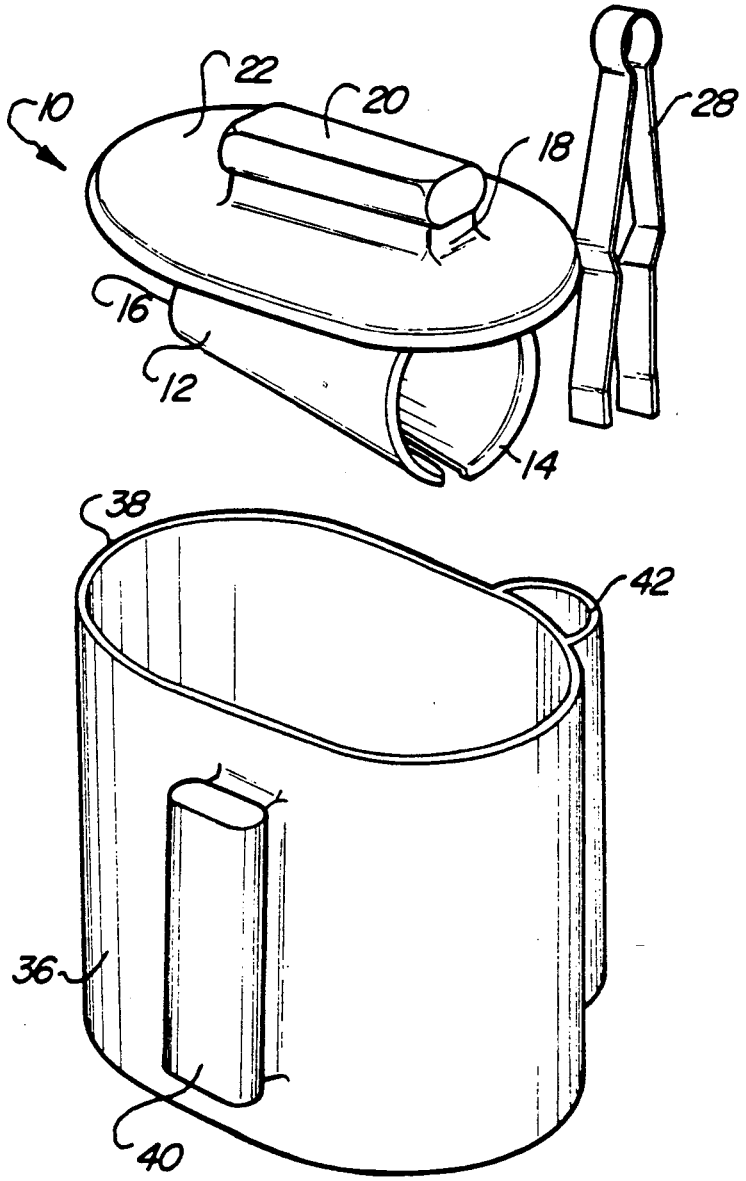
FIG. 5 illustrates the optional container disposed beneath the body portion.

Referring to FIG. 5, the waste removing portion 10 is shown in combination with the tongs 28 and a canister 36 for receiving waste from the portion 10. The canister 36 includes an upper open end 38, a handle 40, and a tong-receiving compartment 42.

The shape and size of the upper open end 38 of the canister 36 substantially coincides with the shape and size of the lid 22. In this way the waste removing portion 10 may be snugly fitted to the top of the canister 36 when not in use to provide convenient storage and to enclose any possible objectionable odors.

The canister 36 includes, in addition to the handle 40 provided conveniently on its outer side, the tong-receiving compartment 42 for receiving and removably holding the tongs 28. Provision of the compartment 42 allows for convenient storage and disposition of the tongs 28 when not in use.

The canister 36 may be used in lieu of the toilet 34 discussed above with respect to FIG. 4. For example, the user may fill the canister 36 with water for rinsing the soiled diaper 30 therein and may draw the diaper 30 through the body 12 above the canister 36. After use, the waste contents of the canister 36 may be poured into the toilet 34 for convenient disposition.

While the canister 36 is an optional feature, its provision is preferred because of its convenience. This embodiment may be especially attractive for travellers.

Having described my invention, however, many modifications thereto will become apparent to those skilled in the art to which it pertains without deviation from the spirit of the invention as defined by the scope of the appended claims.

I claim:

1. An apparatus for substantially removing waste from a soiled diaper and the like, said apparatus comprising:

an elongated conical body having a longitudinal axis, said body having a first end aperture and a second end aperture, said first end aperture being wider than said second end aperture, whereby said diaper is inserted into said first end aperture and is withdrawn from said second end aperture; and means for accommodating the drawing through of said diaper and for exhausting said waste from said body, said means for accommodating the drawing through and exhausting having a slot extending longitudinally through said body to interconnect said first end aperture and said second end aperture.

2. The apparatus for removing waste according to claim 1 wherein said first end aperture is bell-shaped.

3. The apparatus for removing waste according to claim 1 wherein said body further includes means for grasping.

4. The apparatus for removing waste according to claim 3 wherein said means for grasping comprises a handle extending from said body.

5. The apparatus for removing waste according to claim 1 further including means for gripping said soiled diaper and pulling said diaper through said elongated conical body.

6. The apparatus for removing waste according to claim 5 wherein said means for gripping comprises tongs.

7. The apparatus for removing waste according to claim 6 further including a canister having an open top end for receiving said elongated conical body.

8. The apparatus for removing waste according to claim 7 wherein said canister includes an enclosure for removably receiving said tongs.

9. The apparatus for removing waste according to claim 8 wherein said apparatus further includes a lid portion fitted between said body and said handle of said body, said lid portion being sealingly coactable with said open top end of said canister when said lid portion is placed thereon.

10. The apparatus for removing waste according to claim 9 wherein said canister further includes a handle.

11. An apparatus for substantially removing waste from a soiled diaper, said apparatus comprising:

a waste removing portion, said waste removing portion including an elongated conical body having a longitudinal axis, said body having a first end aperture and a second end aperture, said first end aperture having a diameter and said second end aperture having a diameter, said diameter of said first end being greater than said diameter of said second end, said body having a lid portion and a handle longitudinally disposed thereupon; and a canister having an open top for receiving said elongated conical body, said open top being adapted to be sealingly coactable with said lid portion when said lid portion is placed thereon.

12. The apparatus for substantially removing waste according to claim 11, said body further including means for accommodating the drawing through of said diaper and for exhausting said waste.

13. The apparatus for substantially removing waste according to claim 12, wherein said means for accommodating the drawing through and exhausting said waste comprises a slot defined in said body interconnecting said first end aperture and said second end aperture.

14. An apparatus for substantially removing waste from a soiled diaper, said apparatus comprising:

an elongated conical body having a longitudinal axis, said body having a first end aperture and a second end aperture;

said first end aperture having a diameter and said second end aperture having a diameter, said diameter of said first end being greater than said diameter of said second end;

said body further including means for accommodating the drawing through of said diaper and for exhausting said waste; and said body having a handle and a substantially planar lid portion, said planar lid portion being disposed between said conical body and said handle.

15. The apparatus for removing waste according to claim 14 wherein said means for accommodating the drawing through and exhausting comprises a slot longitudinally defined in said bottom region of said body interconnecting said first end portion and said second end portion.

* * * * *